United States Patent [19]

McKee et al.

[11] Patent Number: 5,064,348

[45] Date of Patent: Nov. 12, 1991

[54] DETERMINATION OF WELL PUMPING SYSTEM DOWNTIME

[75] Inventors: Fount E. McKee; Douglas M. Crume, both of Houston, Tex.

[73] Assignee: Delta X Corporation, Houston, Tex.

[21] Appl. No.: 586,177

[22] Filed: Sep. 21, 1990

[51] Int. Cl.[5] ..... F04B 47/00

[52] U.S. Cl. ..... 417/12; 417/18; 417/44; 417/53; 417/43

[58] Field of Search ..... 417/12, 18, 36, 44, 417/43, 53; 166/66

[56] References Cited

U.S. PATENT DOCUMENTS 3,559,731 2/1971 Stafford ..... 417/43

3,854,846 12/1974 Douglas ..... 417/43

4,286,925 9/1981 Standish ..... 417/12

4,507,055 3/1985 Fair et al. ..... 417/53

*Primary Examiner*—Richard A. Bertsch

*Assistant Examiner*—David W. Scheuermann

*Attorney, Agent, or Firm*—Fulbright & Jaworski

[57] ABSTRACT

In a liquid well pumping system which is provided with a downtime between pumpoff cycles, the method of determining the maximum downtime includes running a plurality of tests to determine the relationship between runtime and downtime and determining when the relationship becomes non-linear for at least two consecutive tests. The downtime is selected adjacent the last linear relationship between runtime and downtime for providing a downtime which allows adequate fluid buildup in the well, but not so long a period as to loose well production.

11 Claims, 4 Drawing Sheets

| ΔRT | VALUE |
|---|---|
| 1 | 2' |
| 2 | 2' |
| 3 | 2' |
| 4 | 1.5' |
| 5 | 3.5' |
| 6 | 1.8' |
| 7 | 1.5 |
| 8 | 1.5 |

Fig. 4A

1. $$\frac{\Delta RT1 + \Delta RT2 + \Delta RT3}{3} = \frac{2+2+2}{3} = 2'$$

$$1.5 < 2$$

2. $3.5 > 2$, $\therefore$ $$\frac{\Delta RT1 + \Delta RT2 + \Delta RT3 + \Delta RT4 + \Delta RT5}{5}$$

$$= \frac{2 + 2 + 2 + 1.5 + 3.5}{5} = 2.2$$

3. $1.8 < 2.2$
4. $1.5 < 2.2$
5. $1.5 < 2.5$ $\therefore$ OPTIMUM POINT OCCURRED AT DOWNTIME = 10'

Fig. 4B

DETERMINATION OF WELL PUMPING SYSTEM DOWNTIME

BACKGROUND OF THE INVENTION

It is well known, as disclosed in U.S. Pat. No. 4,286,925, to turn on a liquid well pump after a predetermined downtime when the well has been shut down due to pumpoff. It is known to provide control circuits for shutting off power to a pumping well when the well has been pumped dry or pumped off. Such time clocking of pumping wells has been a standard practice for many years as an attempt to prevent damaging fluid pound due to pumpoff. Generally, over sized pumps are installed on oil wells in order to obtain maximum production, but fluid pound or pumpoff can occur when the pumps remove the liquid faster than the formation's inflow can replace it. Therefore, a downtime should be selected which allows adequate fluid buildup. However, if the downtime is too long a period, the production rate from the well will be decreased.

One method to determine the optimum downtime for a well is to produce a fluid buildup curve. This curve is a plot of pump submergence (fluid depth) on the y axis versus downtime on the x axis. However, gathering the data for creating a fluid buildup curve is disadvantageous because it is difficult and expensive to obtain the information of fluid buildup.

Instead, the present invention is directed to a method of running tests and acquiring data for determining a relationship between pump runtime until pumpoff versus pump downtime to produce a graph for determining the optimum downtime for a well. This method provides a easier way of obtaining data and automatically selects the optimum downtime.

SUMMARY

The present invention is directed to the method of determining the optimum downtime in a liquid well pumping system which is provided with a downtime between pumpoff cycles. The method may include pumping the well until pumpoff occurs for providing a data base for collecting data. Thereafter, a first downtime of a predetermined amount of time is provided. After the expiration of the predetermined time, the pump is run again until pumpoff occurs while measuring the runtime. A plurality of tests is continued of providing downtime and measuring runtime until pumpoff. Thereafter, the relationship between runtime and downtime is determined until it becomes nonlinear, preferably, for at least two consecutive tests. An optimum downtime is selected before the occurrence of the nonlinear relationship. Preferably, the downtime is selected adjacent the last linear relationship for maximum production.

Still a further object of the present invention is wherein the plurality of tests are performed using equal increments of downtime.

Yet a still further object of the present invention is wherein the nonlinearity of the relationship between runtime and downtime is determined by comparing the runtime of each test with the average runtime of all preceding tests.

Still a further objection of the present invention is the provision of a method for determining optimum downtime which includes the steps of pumping the well until pumpoff occurs, providing a first downtime for a predetermined amount of time, again running the pump until pumpoff occurs while measuring the runtime, providing a second downtime for an additional predetermined amount of time, and again running the pump until pumpoff occurs while measuring the runtime. The method includes continuing the last two steps while increasing the downtime by the predetermined amount of time for each test for a plurality of tests, and then determining the average runtime for the first N measurements of runtime. Thereafter, the runtime for the N+1 test is determined and compared with the average runtime. If the runtime of N+1 is equal or greater than the average runtime, then the average runtime of N+1 test is determined. Thereafter, the runtime is determined for the N+2 test and compared to the average runtime of the N+1 test. When the runtime of any test is less than the average of the runtime for the preceding test for at least three tests, the optimum downtime is then determined at the last test which occurred before the decrease in runtime compared to the preceding average.

Yet a still further object of the present invention is wherein the optimum downtime is selected as 30 minutes, and preferably the plurality of tests is at least six and preferably the predetermined amount of downtime is approximately two minutes.

Yet still a further object is wherein the runtime of any test is less than the average by some preset amount of time for at least two tests and the optimum downtime is preferably the downtime at the last test which occurred just before three consecutive tests in which the runtime was less than the average of the runtime for the preceding test.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 4A is a data chart, FIG. 4B is a calculation chart.

BRIEF DESCRIPTION OF THE PREFERRED EMBODIMENT

Figure 1:
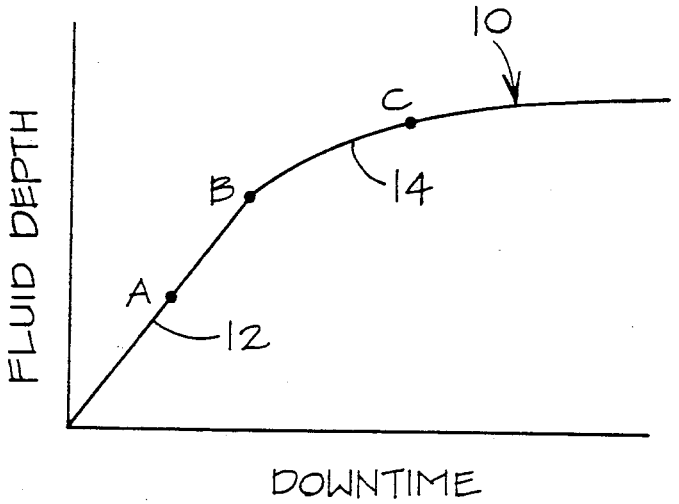
FIG. 1 is a graph of a conventional fluid depth versus downtime which can be used to determine optimum downtime.

Referring now to FIG. 1, a graph generally indicated by the reference numeral 10 is shown of the liquid depth in a well versus downtime. From the graph, it is noted that as the downtime in a liquid pumping well between pumpoff increases, the fluid depth increases along a linear portion 12 of the graph 10. However, after an increase in downtime, the liquid flowing into the well decreases and is inhibited by the liquid accumulating in the well bore. Therefore the graph 10 includes a curved portion 14 in which the increase in downtime does not add substantially to the fluid depth. Generally, it is not desirable to operate at point A or less on the graph 12 as this is inefficient as it does not allow adequate fluid buildup and the pump is started and quickly pumped off.

On the other hand, a downtime equal to that at point C on the graph 10 is undesirable as this means that the maximum amount of oil is not being pumped from the well over a particular period of time. Therefore, it is more efficient to operate at a downtime at point B on the linear portion of the graph 10. However, it is disadvantageous to produce a fluid buildup curve 10 because measuring fluid buildup is time consuming, awkward and expensive.

Instead, the present invention utilizes a curve 50 (FIG. 3) of runtime until pumped off well conditions occur versus downtime as a substitute for the graph 10 of FIG. 1. The present invention is directed to automatically gathering data to build a curve 50 and then select the best point for the optimum downtime for the well being tested.

Figure 2:
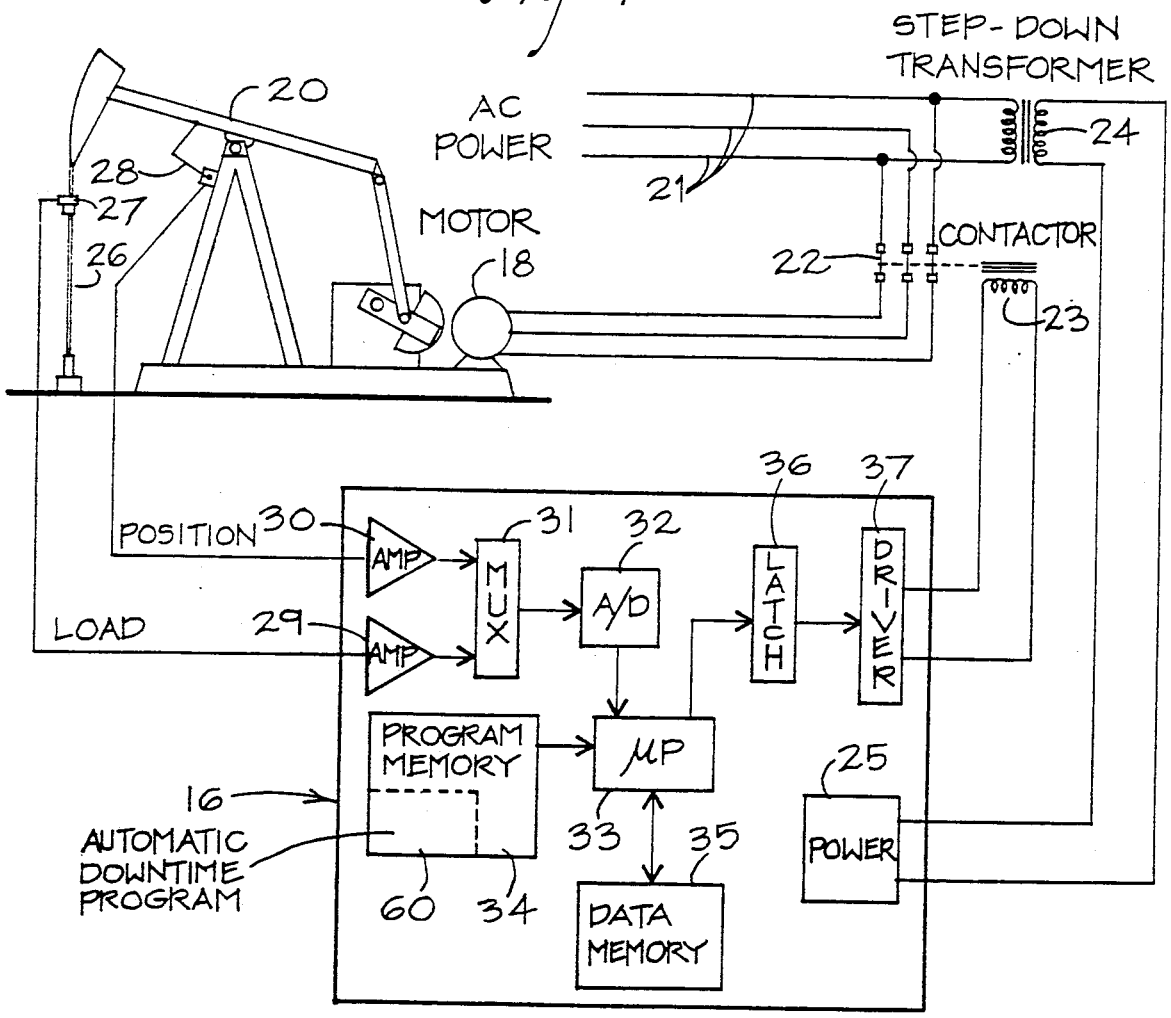
FIG. 2 is a block diagram of a pumpoff control circuit utilizing the method of the present invention.

Referring now to FIG. 2, a pumpoff controller generally indicated by the reference numeral 16 is best seen for turning off power to a drive motor 18 of a conventional oil well pumping unit 20. Electrical power supply lines 21 supply power through contacts 22 controlled by relay 23 and held normally closed allowing power to drive the motor 18 unless the controller 16 operates relay 23 to open the contacts 22 and turn off the electrical power to the motor 18. D.C. power to the controller 16 is provided through transformer 24 and rectifier and regulator 25.

The motor 18 drives the pumping unit 20 to reciprocate a polish rod 26 upwardly and downwardly to actuate a well pump (not shown). A load measuring transducer 27 is connected to the polish rod 26 for providing a signal proportional to load. A position measuring transducer 28 provides a voltage output proportional to the vertical position of the polish rod 26. The outputs from the transducers 27 and 28 are fed to amplifiers 29 and 30, respectively, to a multiplexer 31, to an A/D converter 32 and to a microprocessor 33. By the use of a program memory 34, and data memory 35, the controller 16 may shut off power to the motor 18 when the well has been pumped dry or pumped off and thereafter, after a clocked downtime, may restart the motor 18 through the latch 36 and driver 37. A pumpoff controller 16 as above-described is generally conventional, such as disclosed in U.S. Pat. No. 4,286,925. The present invention includes a pumpoff controller 16 having a program memory with an automatic downtime program 60 which automatically gathers data and calculates the optimum downtime.

Figure 3:
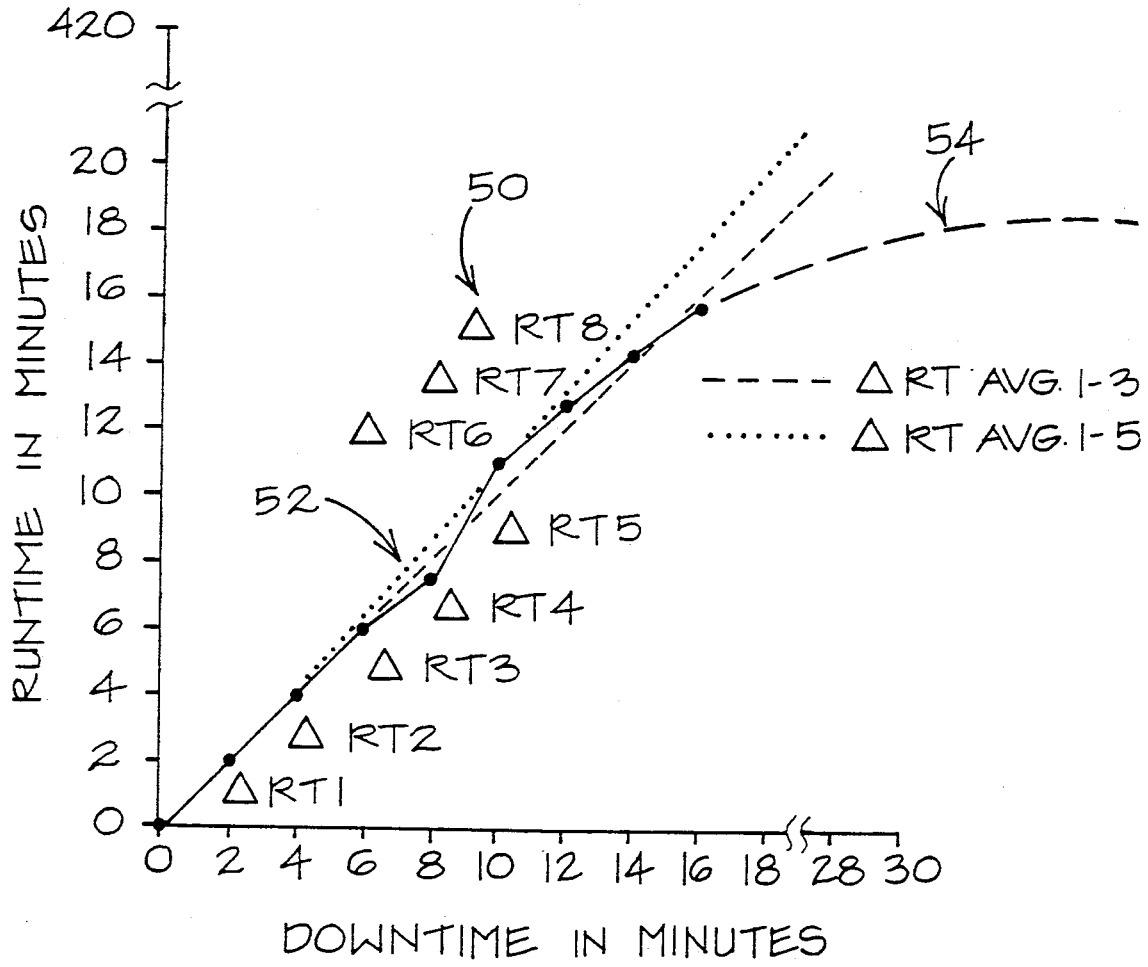
FIG. 3 is an example of a graph of runtime until pumped off versus downtime used in the present invention.

Referring now to FIG. 3, a graph generally indicated by the reference numeral 50 is shown of the runtime until pumped off well conditions occur versus downtime. This graph 50 is a substitute for the conventional graph 10 of FIG. 1 and is used for determining the optimum downtime. The pumpoff controller 16 (FIG. 2) includes a logic flow diagram 60 (FIG. 5), which collects data which could produce the graph 50 of FIG. 3, and which selects the optimum point for the downtime.

Preferably the method of the present invention pumps the well until pumpoff occurs which provides a zero base point for the start of collecting data. Thereafter, a first downtime is selected for a predetermined arbitrary amount of time. After the expiration of the predetermined amount of time, the pump is run until pumpoff occurs and the runtime required until pumpoff occurs is measured. Thereafter, a plurality of tests is continued using the last two steps of increasing the downtime for each test and running the pump until pumpoff occurs while measuring the runtime. With the collected data, the relationship between runtime and downtime can be determined. The controller 16 determines when the relationship between runtime and downtime is on the linear portion 52 of the curve 50. When this relationship becomes non-linear for a certain period, such as at least two consecutive tests, it is then determined that the relationship is no longer non-linear but is on the curved portion 54 of the graph 50. Therefore, further increases in the downtime would lose well production. The controller 16 then selects a downtime. Preferably, the selected downtime is adjacent to the last linear relationship on the linear portion 52 of the graph 50 and before the non-linear relationship existing on the graph portion 54 occurs for maximizing production.

Figure 5:
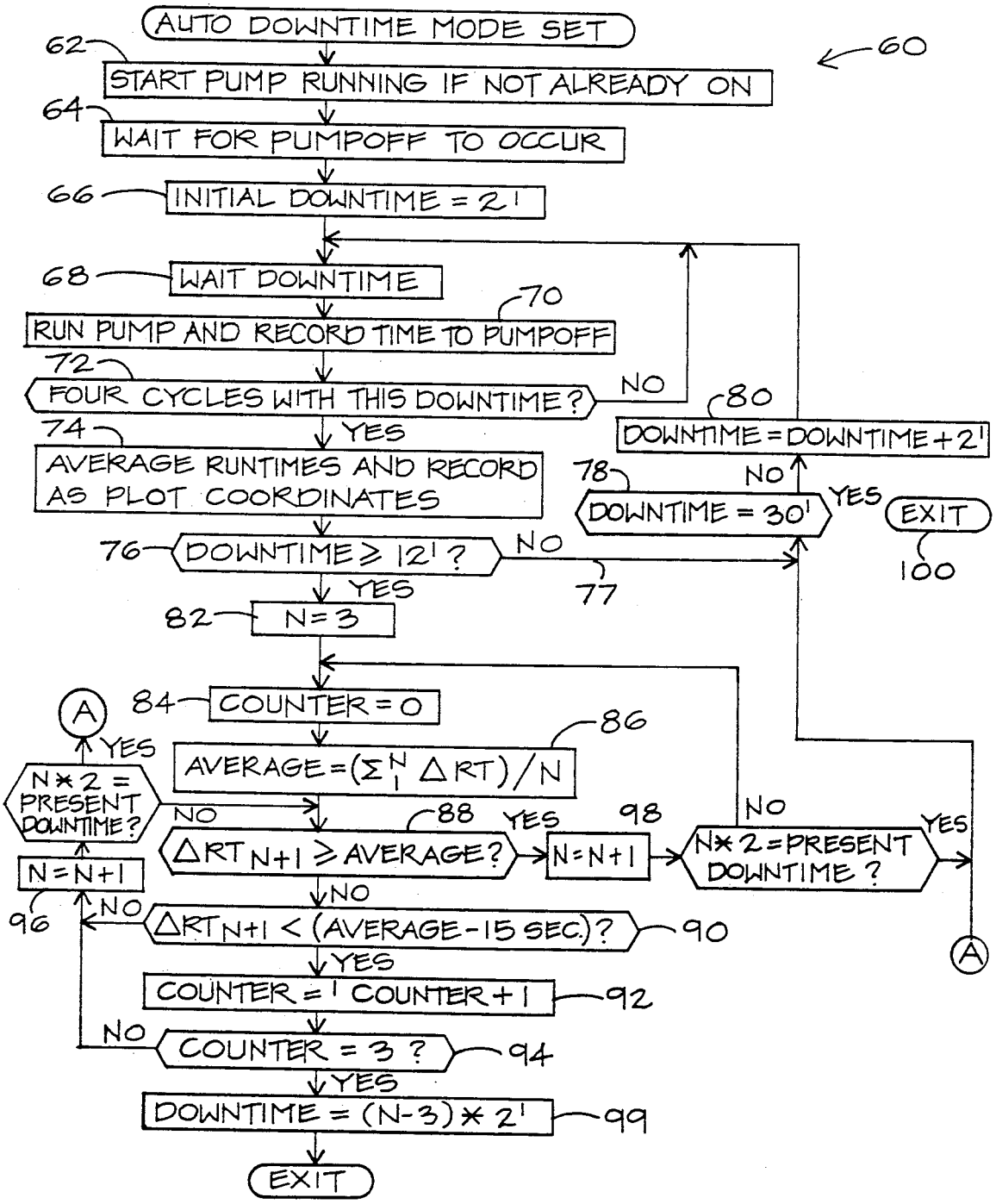
FIG. 5 is a logic flow diagram of the method of the present invention.

While various methods may be utilized to determine the relationship between runtime and downtime and make a determination of the optimum downtime, for purposes of illustration only, one form of a logic flow diagram 60 is best seen in FIG. 5 utilized by the pumpoff controller 16.

With the pumpoff controller 16 set in the operating mode, the first step 62 is to start the well pump motor 18 running, and in step 64 to wait until the well has been pumped dry. That is, when pumpoff occurs, the pump is stopped. These steps initialized the controller for starting the data gathering and determination mode and corresponds to zero minutes and zero runtime on graph 50 in FIG. 3. In order to determine the relationship between runtime and downtime, the downtime increments may be set at any value but for purposes of illustration only, a value of two minutes will be used. Thus, in step 66 an initial downtime, during which time the pump is shut off, is provided for a predetermined amount of time, here selected as two minutes. Step 68 indicates that the downtime is provided and at the end of which step 70 starts and runs the pump to pump fluid from the well while measuring the runtime until pumpoff occurs again. In order to verify the accuracy of this measurement, it is repeated a plurality of times, such as four times in step 72 using the two minute downtime. In step 74 the plurality of cycles is averaged and recorded as the plot coordinate. In the numerical example given in FIGS. 3 and 4A, for the two minute downtime measurement, the runtime until pumpoff occurs was also two minutes, thereby corresponding to the plot of Delta RT1 on graph 50.

In step 74, it is noted whether or not the amount of downtime is greater or equal to a certain amount, here shown as twelve minutes for example. Since only a first downtime test resulting in Delta RT1 has been provided, the method recycles through loop 77. Step 78 determines if the downtime has been at least thirty minutes. Since the downtime in the first step was only two minutes, the method continues to step 80 which adds an additional increment of downtime for the second test. Preferably, the additional increments of downtime provided for in succeeding tests are equal to the initial downtime in step 66 for ease of computation. This cycle is, in this example, repeated five more times to provide data corresponding to graph sections Delta RT2, Delta RT3, Delta RT4, Delta RT5, and Delta RT6. The runtime values in the example given are set forth in the chart in FIG. 4A.

Once the downtime is equal to or greater than twelve minutes as determined in step 76, step 82 determines the number of runtimes to be averaged for calculation purposes, here, for example, three and the counter 84 is actuated to zero to indicate the first averaging calculation. Therefore, in step 86, an average is taken of the runtimes for the first three downtimes and with the data collected in FIG. 4A the equation (1) in FIG. 4B provides an average of two minutes. That is, the average of Delta RT1+Delta RT2+Delta RT3 is two minutes.

In step 88, the runtime for the next succeeding test, which is Delta RT4, is compared with the average calculated in step 86 and in this case since Delta RT4 was 1.5 minutes and the average was two minutes, the program moves to step 90 to determine whether the runtime of Delta RT4 was less than the average by a predetermined amount, here selected as −15 seconds, and since the answer is Yes it proceeds to step 92 to move the counter to +1. However, the counter in step 94 is compared to three, for example only, to determine when the relationship between runtime and downtime becomes non-linear for at least three consecutive cycles which would indicate that the system is operating on the curve portion 54 instead of the linear portion 52 of the graph 50 in FIG. 3. Since the answer is No in step 94, a loop 96 step is provided which sets the number in to N+1 and recycles to step 88. However, in step 88, using the next test, that is Delta RT5. However, Delta RT5, which is 3.5 minutes is greater than the average of two minutes and the loop 98 is entered. This then proceeds to the averaging step 86 which then adds Delta RT4 and Delta RT5 in the average. This is done so that the greatest slope of the curve 50 will be found. Again in step 88, the averages of the first five runtimes is determined as shown in equation (2) in FIG. 4B to be 2.2. Again returning to step 90 the runtime of Delta RT6 of 1.8 minutes is less than the average of 2.2. Then the counter in step 92 is incremented by one and the loop 96 is also continued for RT7 and RT8 which both have averages that are less than 2.2. Therefore, step 94 is reached in which the counter measures three successive or consecutive tests which is less than the average for the preceding tests. Step 99 then backs up three steps to the optimum downtime which is determined to be ten minutes which occurred just before the three consecutive decreasing runtime time differences were found. Therefore, this optimum downtime will avoid the loss in production which would occur if a downtime was chosen that was in the decreasing slope 54 of the curve 50.

Therefore, the present invention provides a method which provides a downtime which is selected to allow adequate fluid buildup in the well, but not so long a period of time as to lose production.

In the event that a sufficient number of tests are run to provide a downtime of thirty minutes without reaching the curved or non-linear portion 54 of the graph 50, then the program moves from step 78 to exit 100 as thirty minutes is a sufficient amount of time to provide adequate buildup without unduly cycling the pump.

The present invention, therefore, is well adapted to carry out the objects and attain the ends and advantages mentioned as well as others inherent therein. While a presently preferred embodiment of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. In a liquid well pumping system which is provided with a downtime between pumpoff cycles, the method of determining the optimum downtime comprising, providing a first downtime for a predetermined amount of time, running the pump until pumpoff occurs while measuring the runtime, continuing, for a plurality of tests, the last two steps, while increasing the downtime for each test, determining when the relationship between runtime and downtime becomes non-linear, and selecting a downtime before the non-linearly relationship.

2. The method of claim 1 including, determining when the relationship between runtime and downtime becomes consecutive tests.

3. The method of claim 1 wherein selecting the downtime is adjacent to the last linear relationship between runtime and downtime.

4. The method of claim 1, wherein the plurality of tests are performed using increasing equal increments of downtime.

5. The method of claim 4, wherein the non-linearality of the relationship between runtime and downtime is determined by comparing the runtime of each test with the average runtime of preceding tests.

6. In a liquid well pumping system, which is provided with a downtime between pumpoff cycles, the method of determining the maximum downtime comprising, pumping the well until pumpoff occurs, providing a first downtime for a predetermined amount of time, again running the pump until pumpoff occurs while measuring the runtime, providing a second downtime for an additional predetermined amount of time, again running the pump until pumpoff occurs while measuring the runtime, continuing the last two steps while increasing the downtime by the predetermined amount of time for each test for a plurality of tests, determining the average runtime for the first N measurements of runtime, determining the runtime for the N+1 test and comparing the runtime to the average runtime, if the runtime N+1 is equal or greater than the average runtime, then determining the average runtime of the N+1 tests, and then determining the runtime for the N+2 test and comparing to the average runtime of the N+1 tests, when the runtime of any test is less than the average of the runtime for the preceding tests for at least three tests, selecting the optimum downtime as the downtime at the last test which occurred before the decrease in runtime compared to the preceding average.

7. The method of claim 6, wherein the maximum downtime is thirty minutes.

8. The method of claim 6, wherein the plurality of tests is at least six.

9. The method of claim 6, wherein the predetermined amount of downtime is approximately two minutes.

10. The method of claim 6, wherein the runtime of any test is less than the average by some preset amount of time for at least two tests.

11. The method of claim 6, wherein the optimum downtime is the downtime at the last test which occurred just before three consecutive tests in which the runtime was less than the average of the runtime for the preceding test.

* * * * *